US005609117A

United States Patent [19]

Suzuki

[11] Patent Number: 5,609,117

[45] Date of Patent: Mar. 11, 1997

[54] THREAD CUTTER FOR SEWING MACHINE

[75] Inventor: Yoshikazu Suzuki, Osaka, Japan

[73] Assignee: Jaguar Co., Ltd., Osaka, Japan

[21] Appl. No.: 539,252

[22] Filed: Oct. 5, 1995

[51] Int. Cl.[6] ..... D05B 65/00

[52] U.S. Cl. ..... 112/288; 112/294; 112/299

[58] Field of Search ..... 112/285, 288, 112/291, 293, 294, 297, 296, 299, 259

[56] References Cited

U.S. PATENT DOCUMENTS

| | | | |
|---|---|---|---|
| 2,535,294 | 12/1950 | Kumbera | 112/299 X |
| 3,186,367 | 6/1965 | Greco | 112/299 X |
| 4,332,209 | 6/1982 | Gauch | 112/294 X |
| 4,655,261 | 4/1987 | Takahashi et al. | 112/294 X |
| 5,203,270 | 4/1993 | Price et al. | 112/288 X |

*Primary Examiner*—Paul C. Lewis
*Attorney, Agent, or Firm*—Lowe, Price, LeBlanc & Becker

[57] ABSTRACT

Obtained is a thread cutter for a sewing machine which can further readily and reliably cut a needle thread, a looper thread or a chain loop by pushing down a knob without driving the sewing machine. In this thread cutter for a sewing machine, a long groove is formed in a needle plate which is positioned behind a presser foot, and a fixed blade is so provided that its cutting edge is along an edge of the long groove. A movable blade which is pressed against the fixed blade by a plate spring is mounted on a spindle, and the spindle is rotated to vertically move the movable blade when the knob frontwardly projecting from the sewing machine is operated. The thread or the chain loop is cut by the vertical movement of the movable blade in association with the fixed blade.

8 Claims, 8 Drawing Sheets

FIG. 9
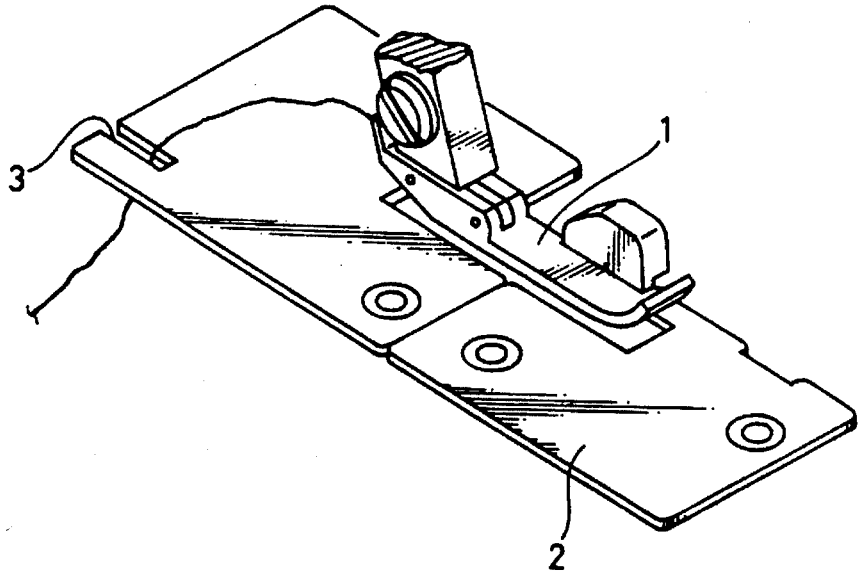
FIG. 10B
FIG. 10A
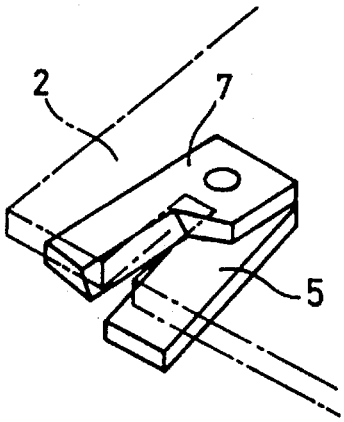
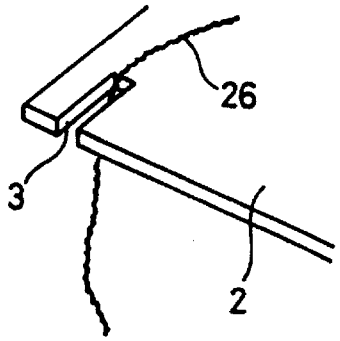

THREAD CUTTER FOR SEWING MACHINE

BACKGROUND OF THE INVENTION

1. Field of the Invention

The present invention relates to a thread cutter for a sewing machine, and more specifically, it relates to a thread cutter which is suitably applied to an overlock sewing machine.

2. Description of the Background Art

In order to start a sewing operation with a sewing machine, a needle thread, a looper thread or a bobbin thread is set on a thread guide, and thereafter the free edge of the thread extending from a thread loop catcher such as a needle, a looper or a shuttle is cut into a proper length if the same is too long. Thus, the free edge of the thread is prevented from being stitched into the seam and deteriorating the appearance of the sewn product.

An overlock sewing machine comprises cutters which consist of an upper and a lower knife blade for trimming a cloth edge. These cutters are also adapted to cut a thread extending from a needle or a looper, or a chain loop which is formed following the end of the seam. However, the presser foot of the sewing machine inhibits the needle thread or the looper thread from being brought into the cutters. In particular, the chain loop which is discharged from a rear part of the presser foot must be extremely detoured to the cutters along the presser foot. Further, it is difficult to drive the cutters for cutting the thread or the chain loop, due to co-movement of the needle and the looper.

A thread cutting blade which is embedded in a rear part of a presser foot or a knee lifter lifting lever for cutting a thread is also known in the art. In this case, however, the thread cutting blade is in a fixed state, and hence the thread must be held with both hands and strained to be smoothly cut with the blade. Thus, a plurality of threads or chain loops cannot be readily cut in a single operation. On the other hand, a slit which is provided in a proper portion of a presser bar for serving as a thread cutter is also known in the art. Also in this case, however, the thread must be held with both hands and strained, to be pushed into the slit and cut along an edge of the slit. Thus, the thread cannot be readily cut, and it is further difficult to cut a plurality of threads or chain loops.

SUMMARY OF THE INVENTION

An object of the present invention is to provide a thread cutter which can readily and reliably cut a needle thread, a looper thread or a chain loop without driving a sewing machine.

Another object of the present invention is to provide a thread cutter which can readily and reliably cut a thread by an operation of pushing down a knob.

A thread cutter for a sewing machine according to an aspect of the present invention comprises a groove, a fixed blade, a movable blade, and a manual control member. The groove is formed in either a needle plate or a sewing machine bed which is positioned behind a presser foot of the sewing machine along a cloth feed direction. The fixed blade is so provided that its cutting edge is along the inner side surface of the groove. The movable blade is adapted to cut either a thread or a chain loop in association with the fixed blade. The manual control member is adapted to drive the movable blade. According to a preferred embodiment, the fixed blade is transversely mounted so that its cutting edge is along an edge of the groove which is formed in the needle plate or the sewing machine bed behind the presser foot, and the movable blade is horizontally swung and moved in contact with the fixed blade, so that the fixed and movable blades will not hinder the sewing operation by upwardly projecting from the needle plate or the bed. According to another preferred embodiment, on the other hand, the fixed blade is vertically mounted so that its cutting edge is along the edge of the groove which is formed in the needle plate or the bed behind the presser foot, and the movable blade is vertically swung or moved in a cantilever manner, to be downwardly brought into contact with the fixed blade in cutting. In an ordinary state, the movable blade is located in a downward position so that its upper surface is flush with or positioned below the surface of either the needle plate or the sewing machine bed.

When the fixed blade is transversely mounted for cutting, the movable blade is closed in general. The movable blade is opened and separated from the fixed blade by an operation of the manual control member so that a needle thread, a looper thread, a bobbin thread or a chain loop is inserted between the fixed and movable blades, and then the movable blade is closed to cut the thread or the chain loop. When the fixed blade is vertically mounted, on the other hand, the movable blade is upwardly moved by an operation of the manual control member so that the thread or the chain loop is inserted between the fixed and movable blades, and then the movable blade is downwardly moved to cut the thread or the chain loop. In either mode, the movable blade may be reciprocated through the operation of the manual control member. Preferably, the movable blade is regularly urged toward the cutting direction by a spring, so that the same is opened or upwardly moved against the action of the spring through the operation of the manual control member. In this case, the thread or the chain loop is automatically cut by the action of the spring when the movable blade is released from the operation of the manual control member in cutting.

The manual control member which drives the movable blade may be formed by any member so far as the same is operated by an operator. For example, the manual control member can be formed by a knob, a lever, a knee lever or a foot pedal, and a push button for exciting a solenoid or the like may also be employed when the mechanism for operating the movable blade is electrically controlled. This manual control member is preferably arranged on the front surface of the sewing machine, in order to facilitate the operation.

In the thread cutter for a sewing machine according to the aforementioned aspect of the present invention, the fixed and movable blades are arranged behind or obliquely behind the presser foot, whereby a needle thread, a looper thread, a bobbin thread or a chain loop can be cut with no hindrance by the presser foot. Further, the thread or the chain loop can be cut by driving the movable blade with the manual control member in a stationary state of the sewing machine without driving the same. Thus, it is possible to readily and reliably cut the thread or the chain loop.

When the movable blade is regularly urged to be closed by the spring, cloth which is set on the sewing machine can be prevented from dropping into a clearance between the movable and fixed blades in sewing so that the same is not damaged by the cutting blade. In cutting, on the other hand, it is possible to automatically cut the thread or the chain loop by simply releasing the movable blade from the operation of the manual control member against the action of the spring, whereby the cutting operation can be further readily carried out. When the thread cutter according to the present invention is applied to an overlock sewing machine, it is possible to cut a needle thread, a looper thread or a chain loop.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 9 is a perspective view of a thread cutter in accordance with an embodiment of the present invention.

FIGS. 10A and 10B illustrates another emodiment of the thread cutter of the present invention.

DESCRIPTION OF THE PREFERRED EMBODIMENTS

Figure 1:
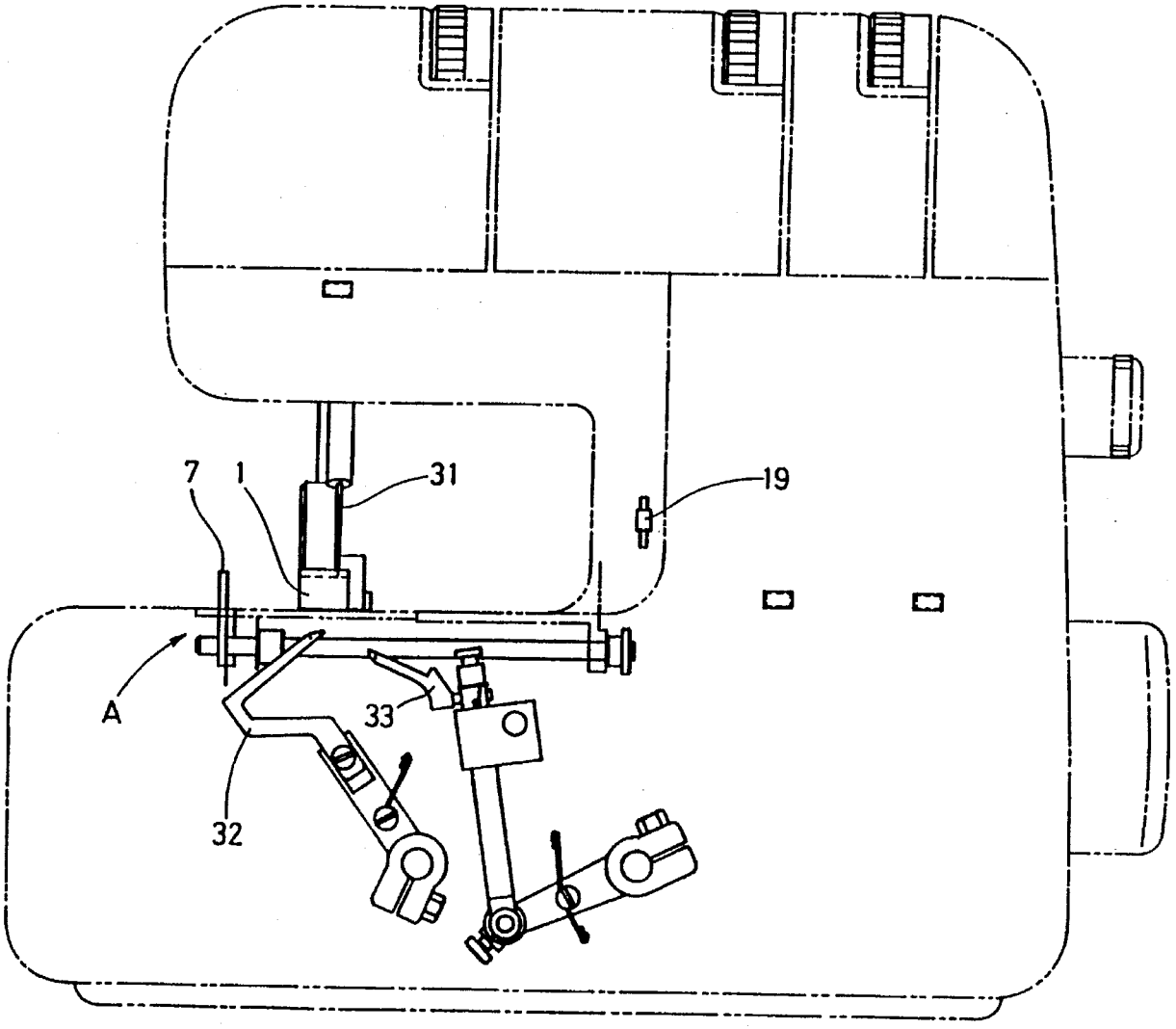
FIG. 1 is a front elevational view showing an overlock sewing machine which is provided with a thread cutter according to the present invention.
Figure 2:
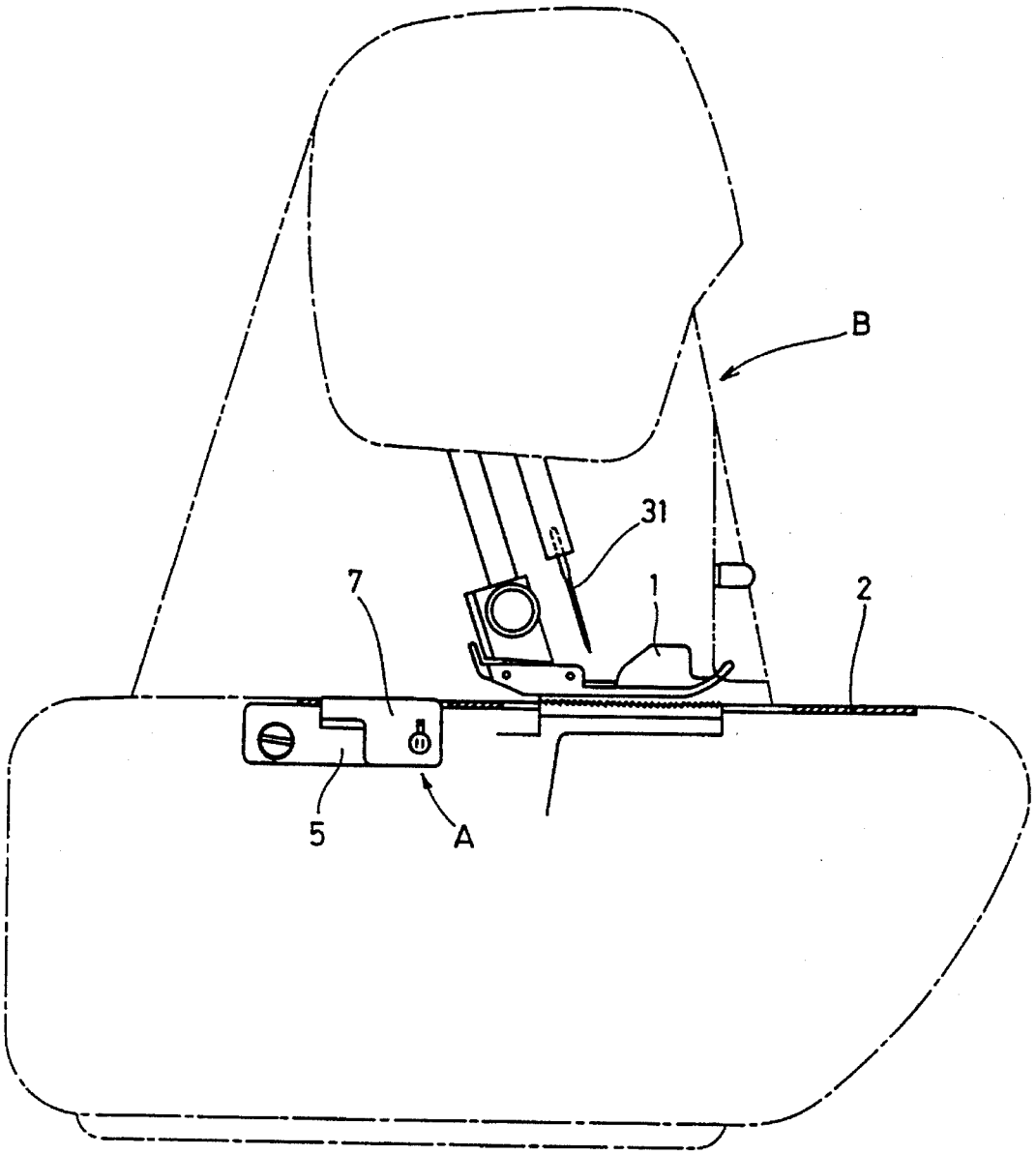
FIG. 2 is a side elevational view of the overlock sewing machine shown in FIG. 1.

FIGS. 1 and 2 illustrate a thread cutter (A) according to the present invention, which is provided on an overlock sewing machine (B). The overlock sewing machine (B) comprises a needle 31, and lower and upper loopers 32 and 33 for forming a single needle triple thread over-edge chain stitch in association with the needle 31. The thread cutter (A) comprises an operation mechanism 6 having a long groove 3, a fixed blade 5, a movable blade 7, and a knob 19 serving as a manual control member.

The long groove 3 is formed in a needle plate 2 which is positioned obliquely behind a presser foot 1, along the cloth feed direction. The fixed blade 5 is vertically screwed to a sewing machine casing 4 along the inner side surface of the long groove 3. The movable blade 7 is connected with the operation mechanism 6 to be vertically swung in the long groove 3, for cutting a thread in association with the fixed blade 5.

Figure 6:
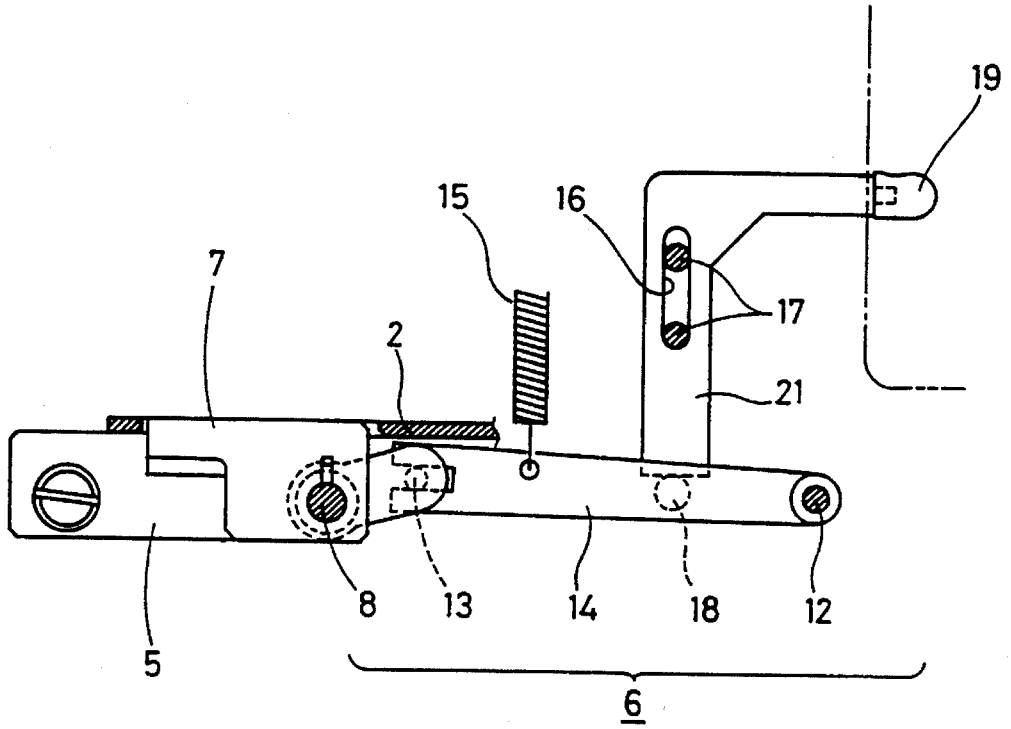
FIG. 6 is a side elevational view showing the thread cutter in sewing.

As shown in FIGS. 3 to 7 in detail, the operation mechanism 6 includes a spindle 8, a pin 9, a plate spring 11, a lever 14, a spring 15, and a control lever 21. The spindle 8 is pivotally supported on the sewing machine casing 4 to be rotatable in a direction perpendicular to that for feeding cloth, and its projecting end which is closer to the sewing machine casing 4 engages with a keyhole 10 provided in the base portion of the movable blade 7 for movably supporting the movable blade 7 in contact with the fixed blade 5. The pin 9 projects from the spindle 8 to engage with the keyhole 10, for rotating the movable blade 7 integrally with the spindle 8. The plate spring 11 is screwed to the sewing machine casing 4 in a cantilever manner, to press the movable blade 7 against the fixed blade 5. An end of the lever 14 is pivotally supported on the sewing machine casing 4 by a pin 12, to be vertically rotatable. Further, a forward fork portion of the lever 14 engages with a crank pin 13 which is connected to the spindle 8. The spring 15 is urged to upwardly move the lever 14. The control lever 21 has a knob 19 serving as a manual control part frontwardly projecting from the sewing machine B. Further, the control lever 21 is supported by a pair of stepped screws 17 which are screwed into the sewing machine casing 4 through a vertical slot 16 to be vertically movable by a constant amount within the range of the slot 16, while the lower end thereof engages with a pin 18 projecting from the lever 14. In general, the control lever 21 is upwardly moved by the action of the spring 15, which moves up the lever 14, so that the lower end of the slot 16 comes into contact with the lower stepped screw 17, as shown in FIG. 6. The movable blade 7 is so downwardly moved that its upper surface is flush with that of the needle plate 2. Alternatively, the upper surface of the movable blade 7 may be positioned below that of the needle plate 2.

Figure 8:
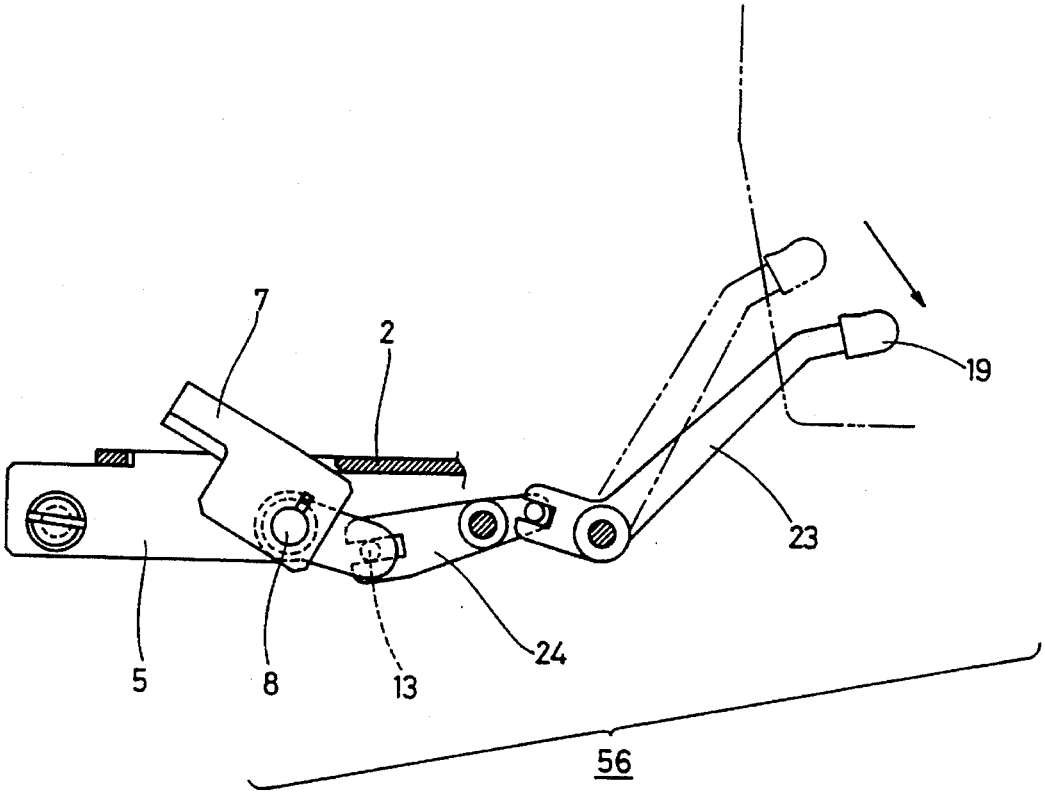
FIG. 8 is a side elevational view showing another embodiment of an operation mechanism for the inventive thread cutter.

FIG. 8 illustrates another exemplary operation mechanism 56. This operation mechanism 56 comprises a bell crank type control lever 23 having a knob 19 which frontwardly projects from the sewing machine, and this control lever 23 is connected to a crank pin 13 of a spindle 8 through a lever 24.

While the long groove 3 and the blades 5 and 7 are arranged along the cloth feed direction to be separated from a seam forming line and prevented from catching the seam and hindering cloth feeding, these elements may alternatively be arranged behind the presser foot 1 along the feed cloth direction, or along a direction which is perpendicular to or crosses with the cloth feed direction.

Figure 3:
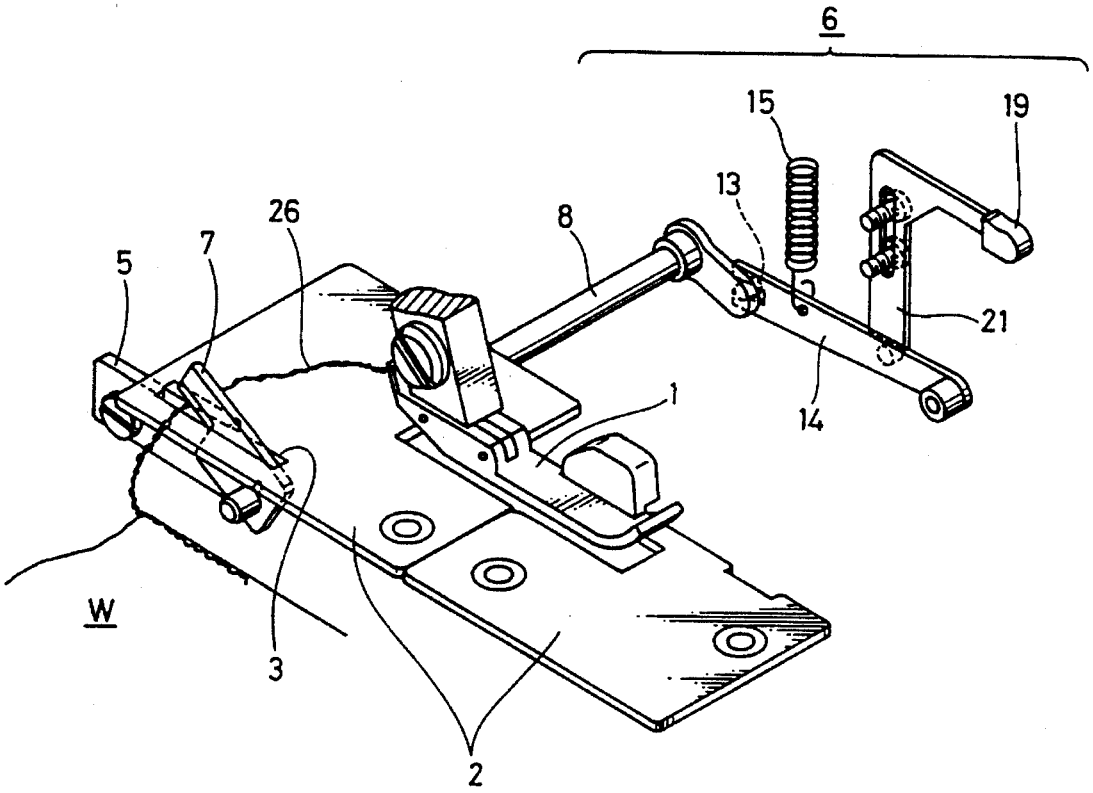
FIG. 3 is a perspective view of the thread cutter which is provided on the overlock sewing machine shown in FIG. 1.
Figure 4:
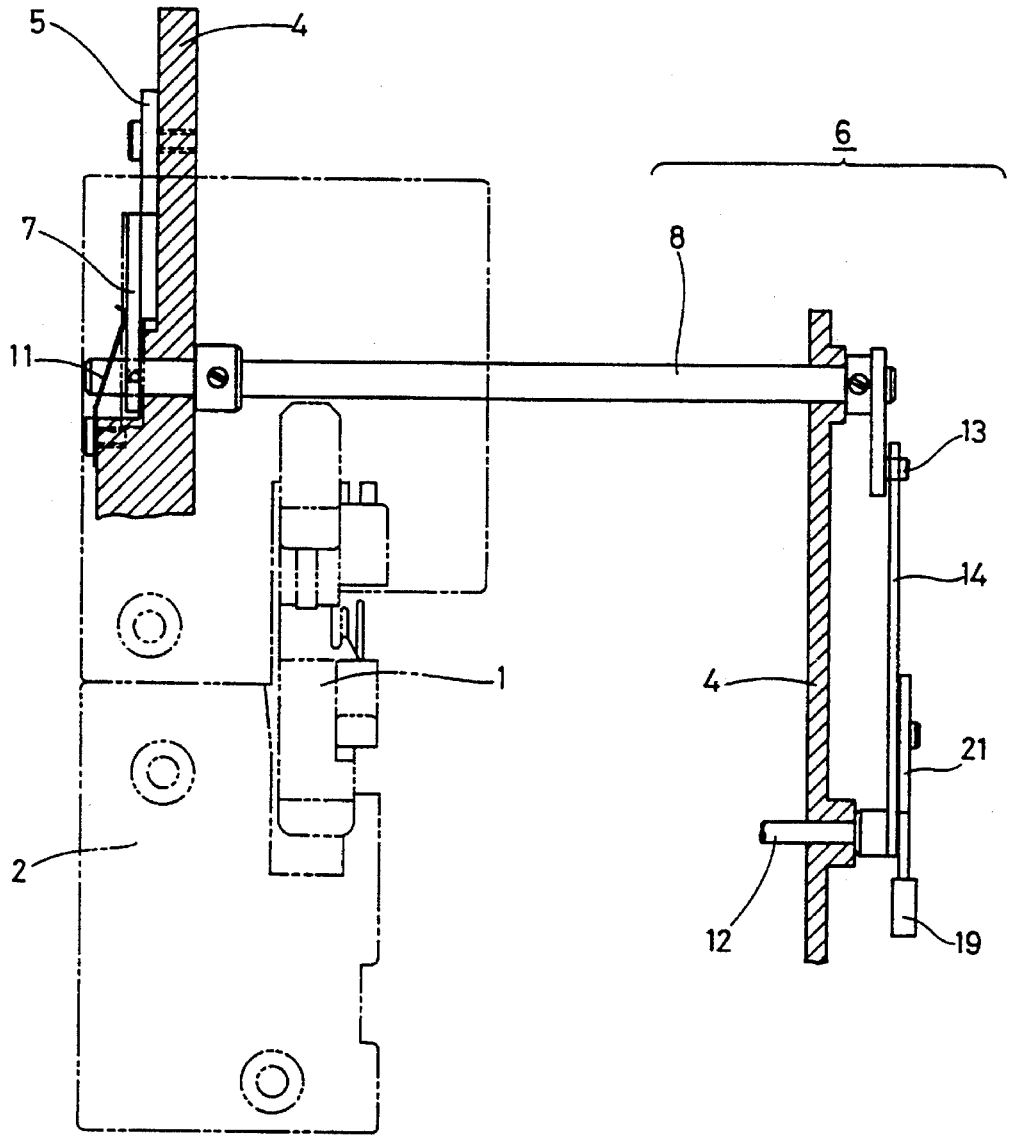
FIG. 4 is a plan view of the thread cutter shown in FIG. 3.
Figure 5:
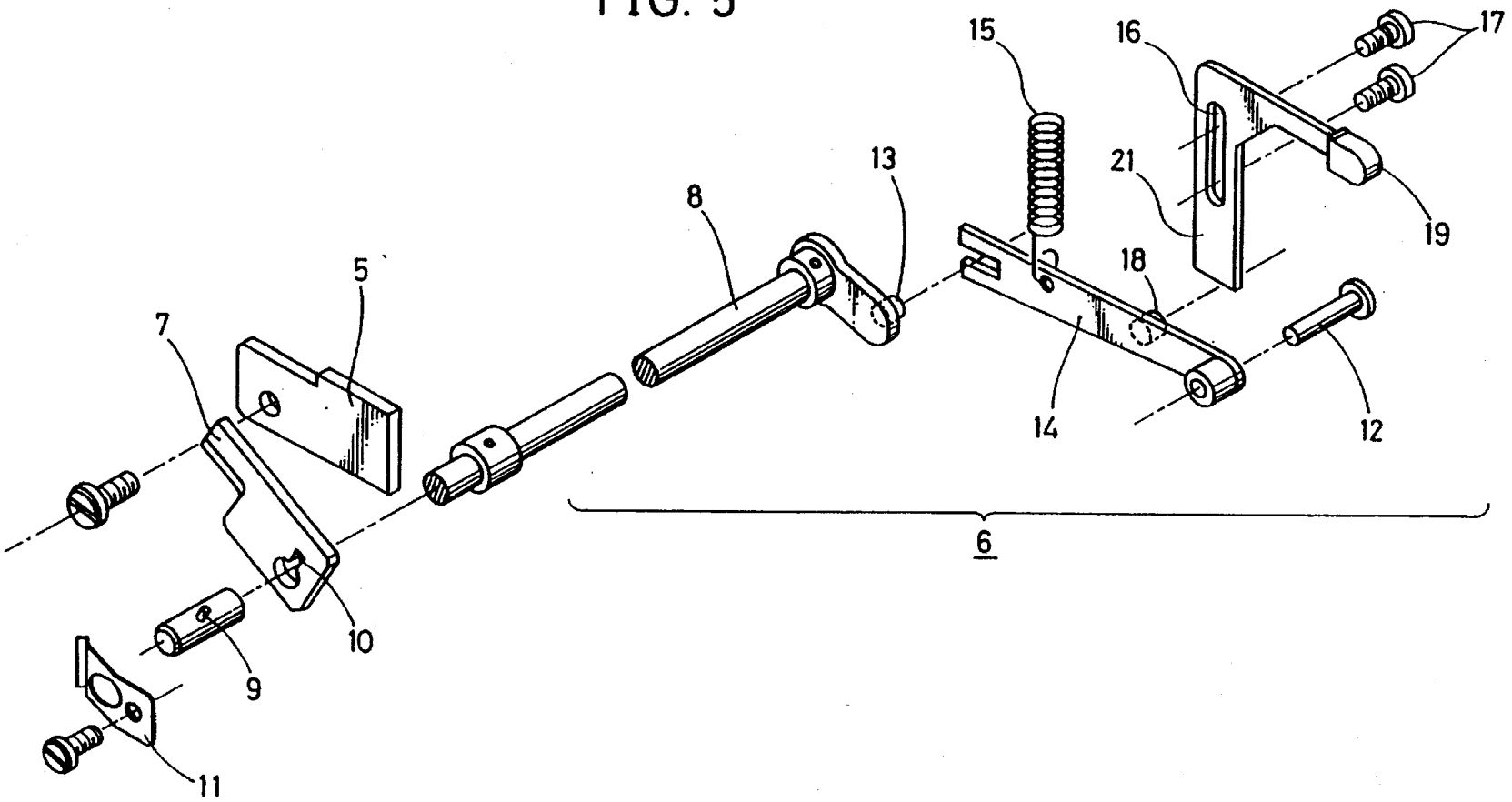
FIG. 5 is an exploded perspective view of the thread cutter shown in FIG. 3.
Figure 7:
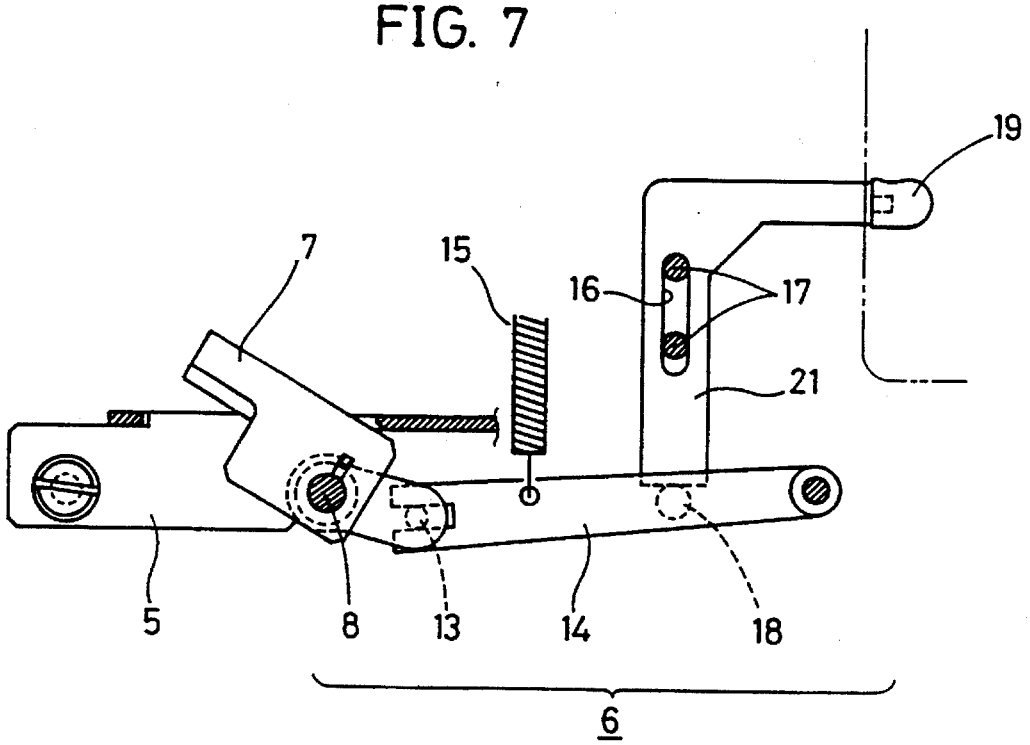
FIG. 7 is a side elevational view showing the thread cutter in sewing.

In order to cut a needle thread, a looper thread or a chain loop, the knob 19 is pushed down from the position shown in FIG. 6 so that the upper end of the slot 16 provided in the control lever 21 comes into contact with the upper stepped screw 17. Thus, the movable blade 7 is upwardly moved as shown in FIG. 7. In this state, the thread or the chain loop is inserted between the fixed blade 5 and the movable blade 7, and thereafter the knob 19 is released. Thus, the movable blade 7 is downwardly moved to the position shown in FIG. 6 due to the action of the spring 15, thereby cutting the thread or the chain loop. FIG. 3 shows an exemplary chain loop 26 which is cut from an end of sewn cloth (W).

The above embodiment has been described with reference to a thread cutter which is applied to an overlock sewing machine, the present invention is also applicable to another type of sewing machine such as a lockstich sewing machine, for cutting a thread or a chain loop.

FIG. 9 illustrates an embodiment of the present invention wherein a cutting edge of the fixed blade is transversely directed and a movable blade is horizontally operated. As in all figures, similar elements bear similar reference numerals.

FIGS. 10A and 10B illustrate an embodiment of the present invention wherein a cutting edge of the fixed blade 5 is transversely directed and the movable blade is horizontally operated.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thread cutter for a sewing machine, comprising:

a groove being formed in either a needle plate or a sewing machine bed entirely positioned obliquely behind a presser foot of said sewing machine along a cloth feed direction, the entire groove extending in a direction substantially parallel to the cloth feed direction;

a fixed blade having a cutting edge and being so provided that its cutting edge is along an inner side surface of said fixed blade;

a movable blade for cutting either a thread or a chain loop in association with said fixed blade; and a manual control member for driving said movable blade.

2. The thread cutter for a sewing machine in accordance with claim 1, further comprising a spring for maintaining said movable blade in a closed state after cutting.

3. The thread cutter for a sewing machine in accordance with claim 1, wherein a cutting edge of said fixed blade is transversely directed, and said movable blade is horizontally operated.

4. The thread cutter for a sewing machine in accordance with claim 1, wherein said manual control member includes one member being selected from the group consisting of a lever and a push button.

5. A thread cutter for a sewing machine, comprising:

a groove being formed in either a needle plate or a sewing machine bed positioned obliquely behind a presser foot of said sewing machine along a cloth feed direction, said groove extending in a direction substantially parallel to the cloth feed direction;

a fixed blade having a cutting edge and being so provided that its cutting edge is along an inner side surface of said fixed blade;

a movable blade for cutting either a thread or a chain loop in association with said fixed blade; and a manual control member for driving said movable blade, wherein a cutting edge of said fixed blade is vertically directed, and said movable blade is vertically moved, the upper surface of said movable blade being flush with or positioned below the surface of either said needle plate or said sewing machine bed.

6. A thread cutter for a sewing machine, comprising:

a groove being formed in either a needle plate of a sewing machine bed being positioned behind a presser foot of said sewing machine along a cloth feed direction;

a fixed blade having a cutting edge and being so provided that its cutting edge is along an inner side surface of said fixed blade;

a movable blade for cutting either a thread or a chain loop in association with said fixed blade; and a manual control member for driving said movable blade; wherein said manual control member is a knob, said thread cutter for a sewing machine further comprising:

a first lever engaged with said knob and being pivotally supported for swinging vertically;

a second lever having an end engaged with said first lever to be moved in association with said first lever, and a rotary shaft having an end being fixed to another end of said second lever, said movable blade being fixed to another end of said rotary shaft.

7. A thread cutter for an overlock sewing machine, comprising:

a groove being formed in either a needle plate or a sewing machine bed positioned obliguely behind a presser foot of said sewing machine along a cloth feed direction, the entire groove extending in a direction parallel to the cloth feed direction;

a fixed blade having a cutting edge and being so provided that its cutting edge is along an inner side surface of said fixed blade;

a movable blade for cutting either a thread or a chain loop in association with said fixed blade; and a manual control member for driving said movable blade.

8. A thread cutter for a sewing machine, comprising:

a groove being formed in either a needle plate or a sewing machine bed being positioned behind a presser foot of said sewing machine along a cloth feed direction;

a fixed blade having a cutting edge and being so provided that its cutting edge is along an inner side surface of said fixed blade;

a movable blade for cutting either a thread or a chain loop in association with said fixed blade; and a manual control member for driving said movable blade, wherein said groove is formed to extend entirely in a direction crossing with said cloth feed direction;

a cutting edge of said fixed blade is transversely directed; and said movable blade is horizontally operated.

* * * * *